US009140520B2

(12) United States Patent
Lopes et al.

(10) Patent No.: US 9,140,520 B2
(45) Date of Patent: Sep. 22, 2015

(54) FIREARM AND CHASSIS SYSTEM

(76) Inventors: John M. Lopes, West Springfield, MA (US); Stephen P. Troy, Lee, MA (US); John Myron Chudzik, West Springfield, MA (US)

( * ) Notice: Subject to any disclaimer, the term of this patent is extended or adjusted under 35 U.S.C. 154(b) by 358 days.

(21) Appl. No.: 13/281,462

(22) Filed: Oct. 26, 2011

(65) Prior Publication Data

US 2012/0102803 A1 May 3, 2012

Related U.S. Application Data

(60) Provisional application No. 61/407,871, filed on Oct. 28, 2010.

(51) Int. Cl.

| | |
|---|---|
| ***F41C 23/00*** | (2006.01) |
| ***F41C 23/16*** | (2006.01) |
| ***F41C 27/00*** | (2006.01) |
| ***F41G 1/02*** | (2006.01) |
| ***F41G 1/06*** | (2006.01) |

(52) U.S. Cl.

CPC ..... *F41C 23/16* (2013.01); *F41C 27/00* (2013.01); *F41G 1/02* (2013.01); *F41G 1/06* (2013.01)

(58) Field of Classification Search

CPC ..... F41C 13/16; F41C 27/00
USPC ..... 42/71.01, 75.01, 75.02, 75.03, 124
See application file for complete search history.

(56) References Cited

U.S. PATENT DOCUMENTS

| | | | | | |
|---|---|---|---|---|---|
| 4,358,986 | A * | 11/1982 | Giorgio | 89/142 |
| 4,601,124 | A * | 7/1986 | Brown, Jr. | 42/75.03 |
| 5,533,292 | A * | 7/1996 | Swan | 42/123 |
| 5,540,008 | A * | 7/1996 | Kirnstatter | 42/75.02 |
| 5,590,484 | A * | 1/1997 | Mooney et al. | 42/111 |
| 5,900,577 | A * | 5/1999 | Robinson et al. | 89/191.01 |
| 6,070,352 | A * | 6/2000 | Daigle | 42/49.02 |
| 6,839,998 | B1 * | 1/2005 | Armstrong | 42/71.01 |
| 7,581,954 | B2 * | 9/2009 | Schavone | 434/18 |
| 7,685,758 | B2 * | 3/2010 | Romer | 42/124 |
| 7,802,392 | B2 * | 9/2010 | Peterson et al. | 42/75.03 |
| 7,814,699 | B2 * | 10/2010 | Storch et al. | 42/137 |
| 7,905,041 | B1 * | 3/2011 | Davies | 42/75.02 |
| 7,971,379 | B2 * | 7/2011 | Robinson et al. | 42/7 |
| 8,051,595 | B2 * | 11/2011 | Hochstrate et al. | 42/75.01 |
| 8,091,265 | B1 * | 1/2012 | Teetzel et al. | 42/72 |
| 8,141,287 | B2 * | 3/2012 | Dubois | 42/75.02 |
| 8,205,373 | B1 * | 6/2012 | Ubl et al. | 42/71.01 |
| 8,215,046 | B2 * | 7/2012 | Chvala | 42/71.01 |
| 8,230,634 | B1 * | 7/2012 | Davies et al. | 42/75.02 |
| 8,234,808 | B2 * | 8/2012 | Lewis et al. | 42/73 |
| 8,336,243 | B2 * | 12/2012 | Langevin et al. | 42/71.01 |
| 8,347,540 | B2 * | 1/2013 | Sirois | 42/75.01 |

(Continued)

*Primary Examiner* — Michelle R Clement

(74) *Attorney, Agent, or Firm* — Robert A. Parsons; Michael W. Goltry; Parsons & Goltry

(57) ABSTRACT

A chassis system and firearm including a chassis having a forward end terminating in a barrel support member, a rearward end, and a cavity defined by the chassis intermediate the forward end and the rearward end. A receiver with attached barrel is received in the cavity, and the barrel is received in the barrel support member. A handguard including a rearward end having a split therein and movable between a normally expanded configuration and a contracted configuration is carried over and encircling the barrel. The rearward end is slidably received over the barrel support member in the expanded configuration and securely engaged to the barrel support member in the contracted configuration.

17 Claims, 7 Drawing Sheets

(56) References Cited

U.S. PATENT DOCUMENTS

| | | | | |
|---|---|---|---|---|
| 8,522,467 | B1 * | 9/2013 | Christensen et al. | 42/71.01 |
| 2005/0229463 | A1 * | 10/2005 | Tashjian | 42/75.02 |
| 2005/0235546 | A1 * | 10/2005 | Wonisch et al. | 42/75.01 |
| 2006/0260169 | A1 * | 11/2006 | Samson et al. | 42/72 |
| 2007/0261285 | A1 * | 11/2007 | Troy | 42/75.03 |
| 2009/0000173 | A1 * | 1/2009 | Robinson et al. | 42/75.02 |
| 2009/0007477 | A1 * | 1/2009 | Robinson et al. | 42/75.02 |
| 2009/0126249 | A1 * | 5/2009 | Crommett | 42/71.01 |
| 2009/0288324 | A1 * | 11/2009 | Peterson et al. | 42/75.03 |
| 2010/0037505 | A1 * | 2/2010 | Romer | 42/124 |
| 2010/0162608 | A1 * | 7/2010 | McCann | 42/71.01 |
| 2010/0212201 | A1 * | 8/2010 | Kincel et al. | 42/2 |
| 2010/0269392 | A1 * | 10/2010 | Swan | 42/71.01 |
| 2010/0300277 | A1 * | 12/2010 | Hochstrate et al. | 89/179 |
| 2011/0000119 | A1 * | 1/2011 | Desomma et al. | 42/75.02 |
| 2011/0185617 | A1 * | 8/2011 | Brixius | 42/71.01 |
| 2011/0192066 | A1 * | 8/2011 | Kimmel et al. | 42/71.01 |
| 2011/0239513 | A1 * | 10/2011 | Sandman | 42/90 |
| 2012/0079752 | A1 * | 4/2012 | Peterson et al. | 42/75.02 |
| 2012/0117845 | A1 * | 5/2012 | Desomma | 42/75.02 |
| 2012/0180354 | A1 * | 7/2012 | Sullivan et al. | 42/16 |
| 2012/0180358 | A1 * | 7/2012 | Samson et al. | 42/71.01 |
| 2012/0246989 | A1 * | 10/2012 | Troy | 42/71.01 |
| 2012/0291329 | A1 * | 11/2012 | Ubl et al. | 42/71.01 |
| 2012/0297656 | A1 * | 11/2012 | Langevin et al. | 42/16 |
| 2012/0317859 | A1 * | 12/2012 | Brown | 42/71.01 |
| 2013/0014418 | A1 * | 1/2013 | Dextraze et al. | 42/16 |
| 2013/0068089 | A1 * | 3/2013 | Brown | 89/193 |
| 2013/0205637 | A1 * | 8/2013 | Patel | 42/75.02 |

* cited by examiner

FIREARM AND CHASSIS SYSTEM

CROSS-REFERENCE TO RELATED APPLICATION

This application claims the benefit of U.S. Provisional Application No. 61/407,871, filed 28 Oct. 2010.

FIELD OF THE INVENTION

This invention relates to Firearms.

More particularly, the present invention relates to component and attachment systems for firearms.

BACKGROUND OF THE INVENTION

In the field component attachment systems for firearms, typically rails are employed. Rail systems are small pieces of metal put on any given surface of a firearm to allow attachment of some sort of component. Rails were originally used to attach telescopic sights to rifles. However, their use has been expanded to include attachment of laser aiming modules, tactical lights, night vision devices, reflex sights, foregrips, bipods, bayonets and the like. Rails facilitate the mounting and dismounting of these components. Rail systems usually are based on the handguard of a weapon or the Upper receiver. Two types of rail systems for firearms are the Picatinny rail and the Weaver rail. For firearms that do not have a rail formed on or attachable to the receiver, the answer is typically to employ a handguard having rails. While effective for most applications, a handguard can be difficult to mount on some firearms, particularly those that do not employ an enlarged barrel nut.

Additionally, with the advent of the rail systems, iron sights have often been replaced with rails. Multiple types of sighting systems can then be attached to the rails. However, it may be beneficial to have iron or open sights available at all time if their use becomes desirable. Currently, these sights cannot be used with a rail system because they will block the rail and prevent attachment of additional components. A rail typically includes a series of ridges with a T-shaped cross-section interspersed with flat spacing slots. Components are often mounted by sliding them on from one end or the other of the rail. Fixed sights can block the attachment of components and interfere with their proper use if installation is possible. It would be highly advantageous, therefore, to remedy the foregoing and other deficiencies inherent in the prior art.

An object of the present invention is to provide a chassis to permit attachment of a handguard to a firearm.

Another object of the present invention is to provide sights on the rail of the handguard that do not block use of the rail.

SUMMARY OF THE INVENTION

Briefly, to achieve the desired objects and advantages of the instant invention, provided is a chassis system for use on a firearm having a barrel extending from a receiver. The chassis system includes a chassis with a forward end terminating in a barrel support member, a rearward end, and a cavity defined by the chassis intermediate the forward end and the rearward end. The receiver is receivable in the cavity with the barrel received in the barrel support member. A handguard is positionable over and encircling the barrel. The handguard includes a rearward end having a split therein and movable between a normally expanded configuration and a contracted configuration. The rearward end is slidably receivable over the barrel support member in the expanded configuration and securely engagable to the barrel support member in the contracted configuration.

In a specific aspect, the chassis system includes a top rail extending along a length of the handguard and extending beyond the rearward end thereof for overlying engagement with the receiver. The top rail includes an embedded front sight moveable between a raised position and a lowered position flush with or below a top surface of the top rail. The top rail also includes an embedded rear sight moveable between a raised position and a lowered position flush with or below a top surface of the top rail.

In yet another aspect of the present invention, provided a chassis system and firearm including a chassis having a forward end terminating in a barrel support member, a rearward end terminating in a butt stock receiving member, and a cavity formed in the chassis intermediate the forward end and the rearward end. A receiver is received in the cavity, the receiver including a trigger mechanism extending through an opening in the chassis. A barrel extends from the receiver and is received in the barrel support member. A handguard is positioned over and encircles the barrel. The handguard includes a rearward end having a split therein and movable between a normally expanded configuration and a contracted configuration. The rearward end is slidably received over the barrel support member in the expanded configuration and securely engaged to the barrel support member in the contracted configuration. A clamping member bridges the split in the rearward end of the handguard and moves the rearward end from the normally expanded configuration to the contracted configuration.

In still another aspect, the chassis system and firearm includes a top rail extending along a length of the handguard and extends beyond the rearward end thereof in overlying engagement with the receiver. The top rail includes an embedded rear sight moveable between a raised position and a lowered position flush with or below a top surface of the top rail. A socket is formed in the top rail. A biased pin is journaled through the top rail at the socket and through a base of the rear sight for pivotal movement of the rear sight between a raised position and a lowered position. A lock element is carried by an end of the pin. The lock element is receivable in selected indentations formed in a side of the top rail at the socket.

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
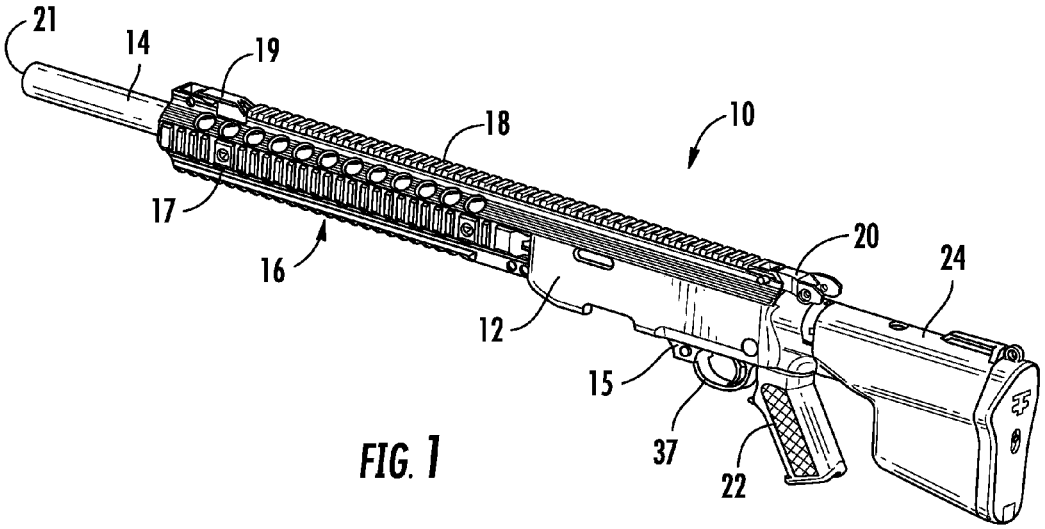
FIG. 1 is a perspective view of a firearm with a chassis system according to the present invention.
Figure 2:
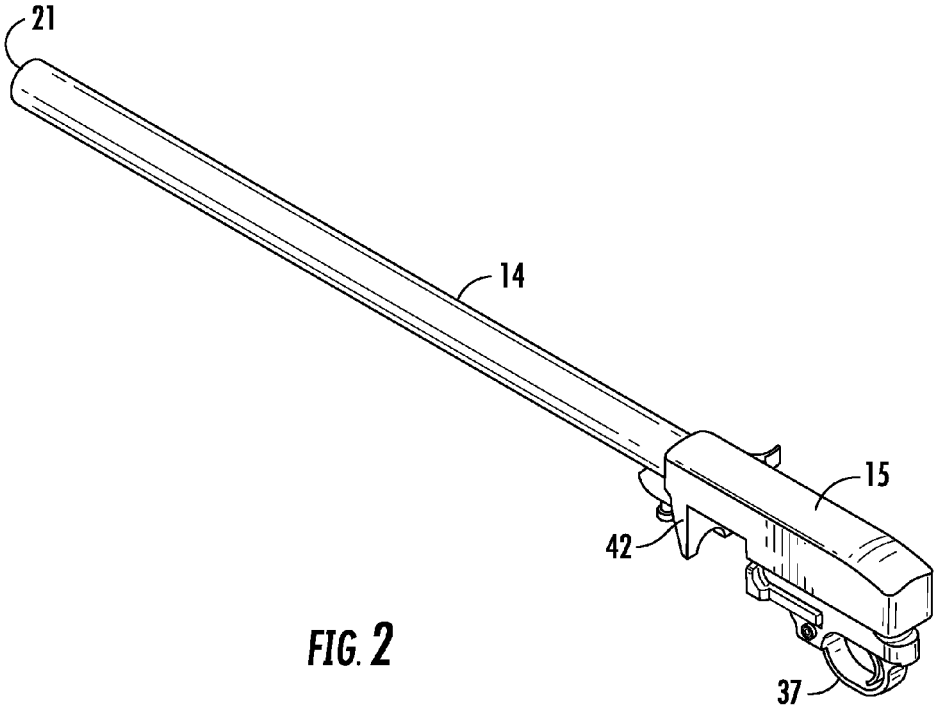
FIG. 2 is a perspective view of a receiver and attached barrel of a conventional firearm.

Turning now to the drawings in which like reference characters indicate corresponding elements throughout the several views, attention is directed to FIG. 1 which illustrates a firearm system 10 having a chassis 12 according to the present invention. Firearm system 10, in this specific embodiment includes a barrel 14 and a receiver 15 from a convention firearm commonly referred to as a Ruger 1022 (FIG. 2). Firearm system 10 further includes a handguard 16 coupled to chassis 12. Handguard 16, in this embodiment, includes a handguard portion 17 and a top rail 18 extending along and rearwardly beyond the top of handguard portion 17. Top rail 18 carries an embedded front sight 19 and an embedded rear sight 20. Top rail 18 extends rearwardly beyond handguard portion 17 and is received in overlying relationship with receiver 15. Rifle system 10 can also includes pistol grip 22 and butt stock 24 attached to chassis 12. For purposes of this description, forward is a direction toward a muzzle 21 of firearm 10 and rearward is toward butt stock 24 of firearm 10.

With reference specifically to FIG. 2, is can be seen that in this type of firearm barrel 14 is attached to receiver 15 without the use of a barrel nut. The absence of a barrel nut or similar structure can make it difficult to attach a free floating handguard. The present invention overcomes this problem with the use of chassis 12 which will be described presently.

Figure 3:
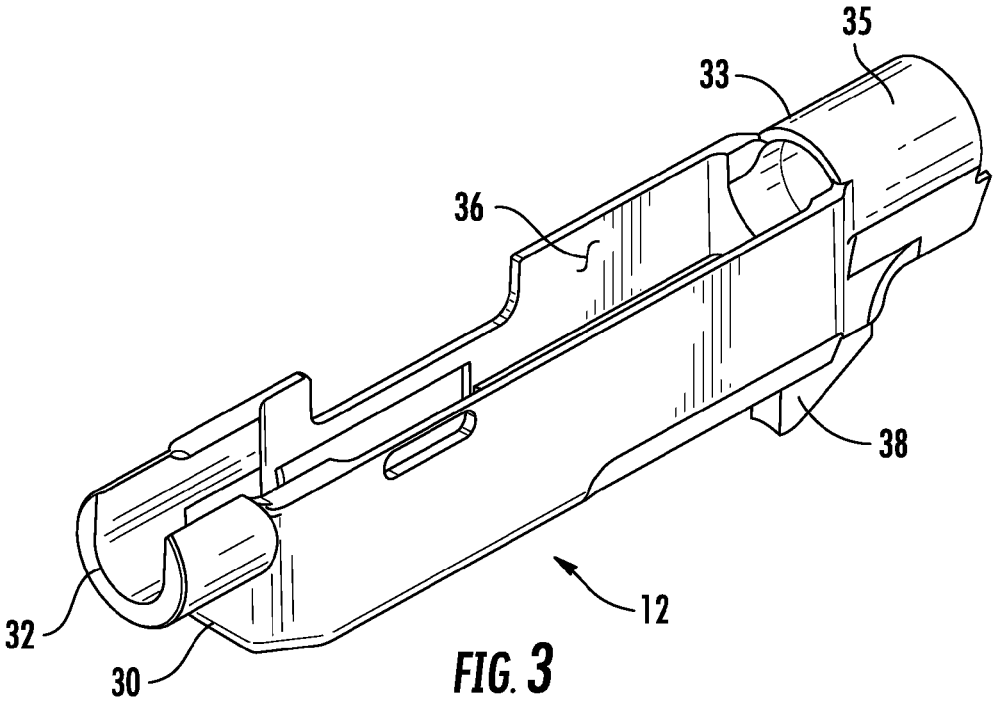
FIG. 3 is a top perspective view of a chassis according to the present invention.
Figure 4:
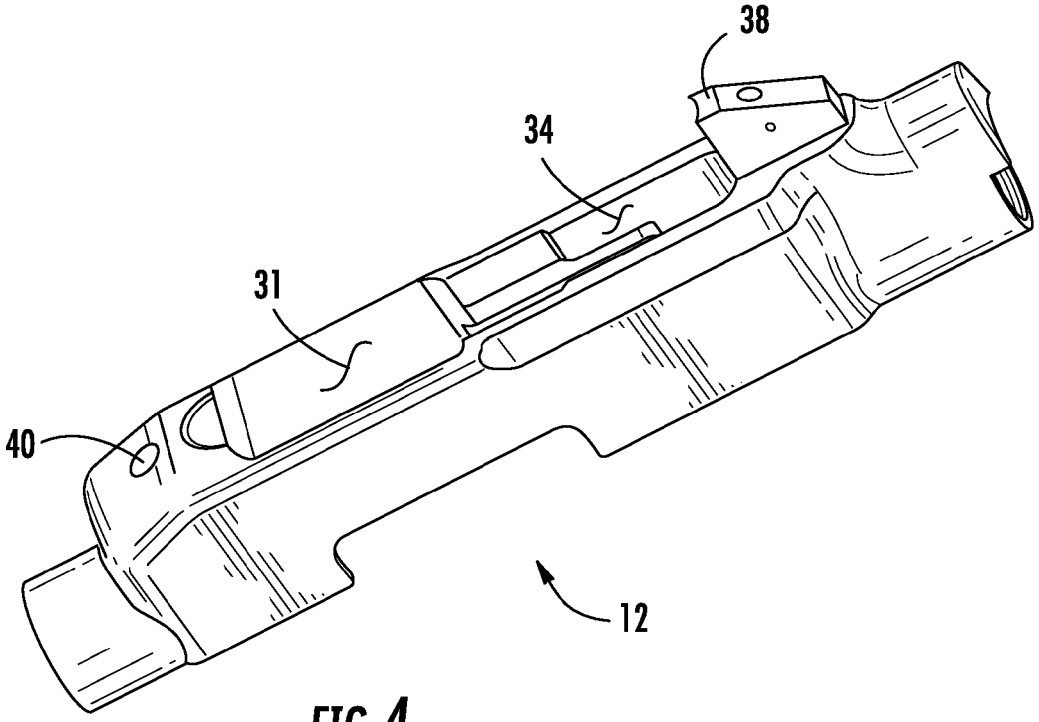
FIG. 4 is a bottom perspective view of the chassis of FIG. 3.
Figure 5:
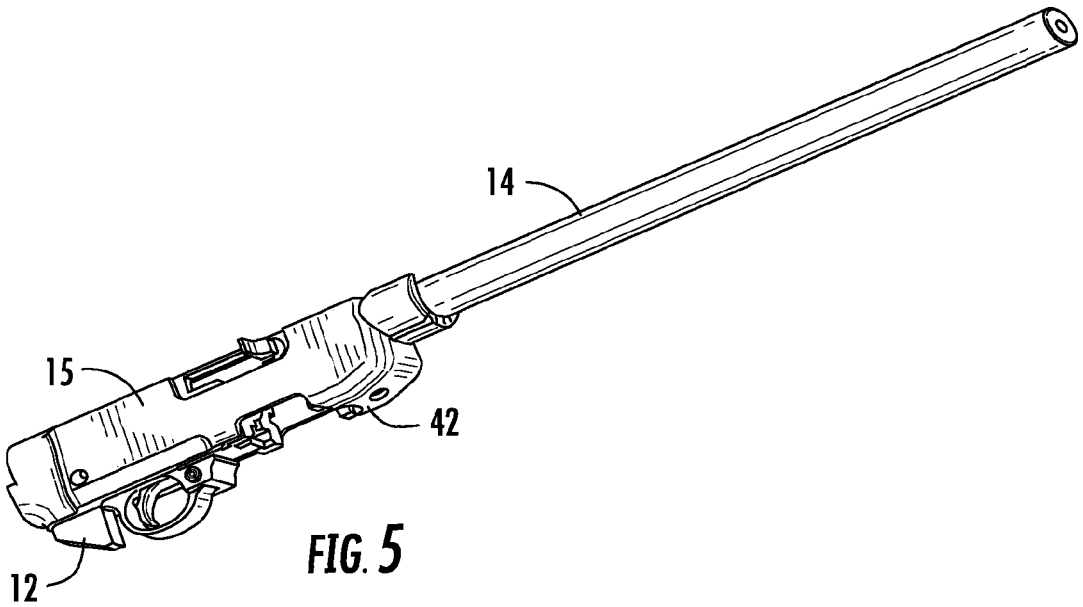
FIG. 5 is a perspective view of a receiver and attached barrel of a conventional firearm, with the chassis installed.

Referring to FIGS. 3 and 4, chassis 12 is illustrated. Chassis 12 includes a forward end 30 terminating in a barrel support member 32 and a rearward end 33 terminating in a butt stock receiving member 35. Intermediate end 30 and end 33 is a cavity 36 for receiving receiver 15, with barrel 14 received in barrel support member 32. Chassis 12 has openings in the bottom thereof for access to various elements. An opening 31 is positioned to receive a trigger mechanism 37 therethrough (FIG. 1), and an opening 34 is provided for access to the magazine well receiver 15, not shown. Chassis 12 also includes a pistol grip receiving member 38 proximate end 33. An aperture 40 is formed in the bottom surface of chassis 12 proximate forward end 30 corresponding to an aperture formed in receiver 15. In the conventional firearm using receiver 15 and barrel 14, a screw 42 (take down screw) is removed, along with other fasteners, to permit removal of the barrel 14 and receiver 15 from the conventional stock. Screw 42 can be utilized to secure chassis 12 to receiver 15. Screw 42 is inserted through aperture 40 and threaded into the aperture in the bottom of receiver 15 (FIG. 5).

Figure 6:
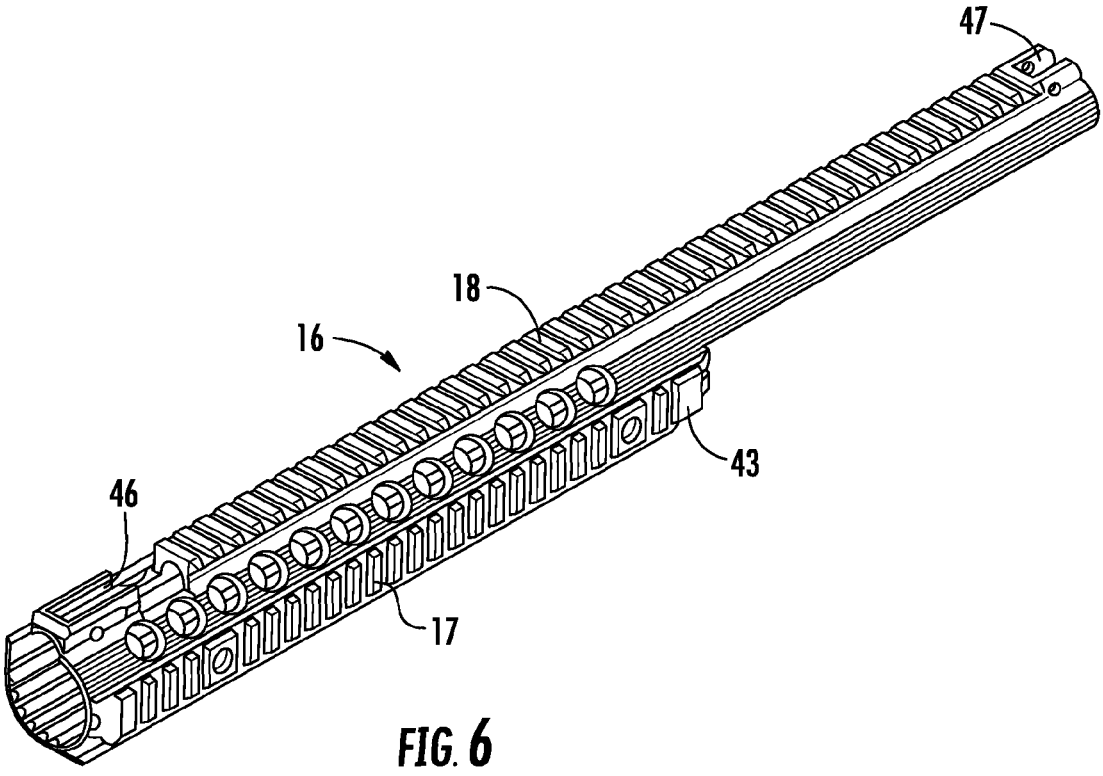
FIG. 6 is perspective view of a handguard for attachment to the chassis.
Figure 7:
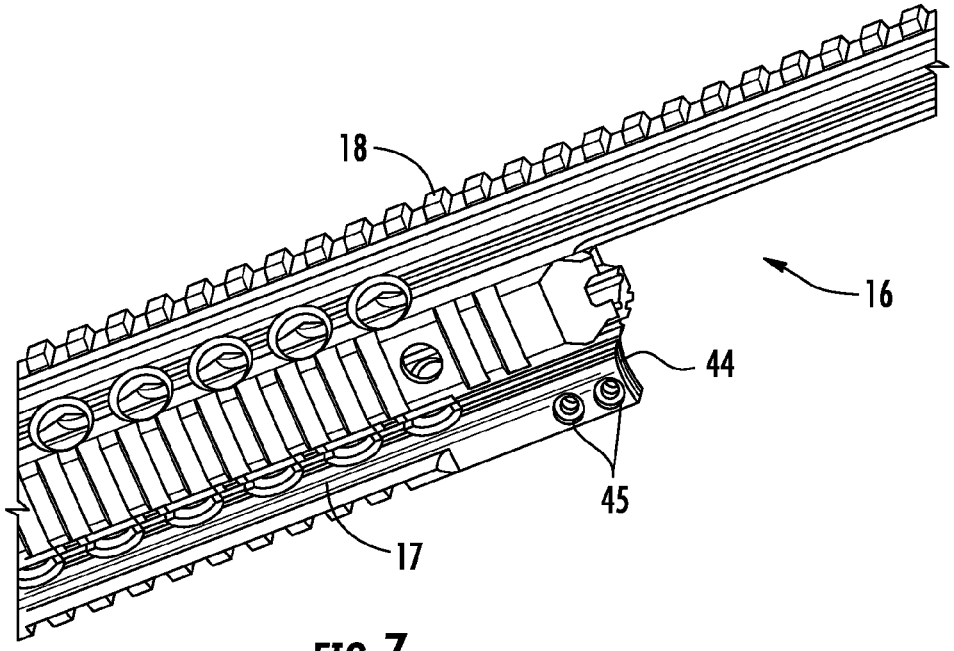
FIG. 7 is an enlarged perspective view of the handguard of FIG. 6, illustrating a clamping mechanism.
Figure 8:
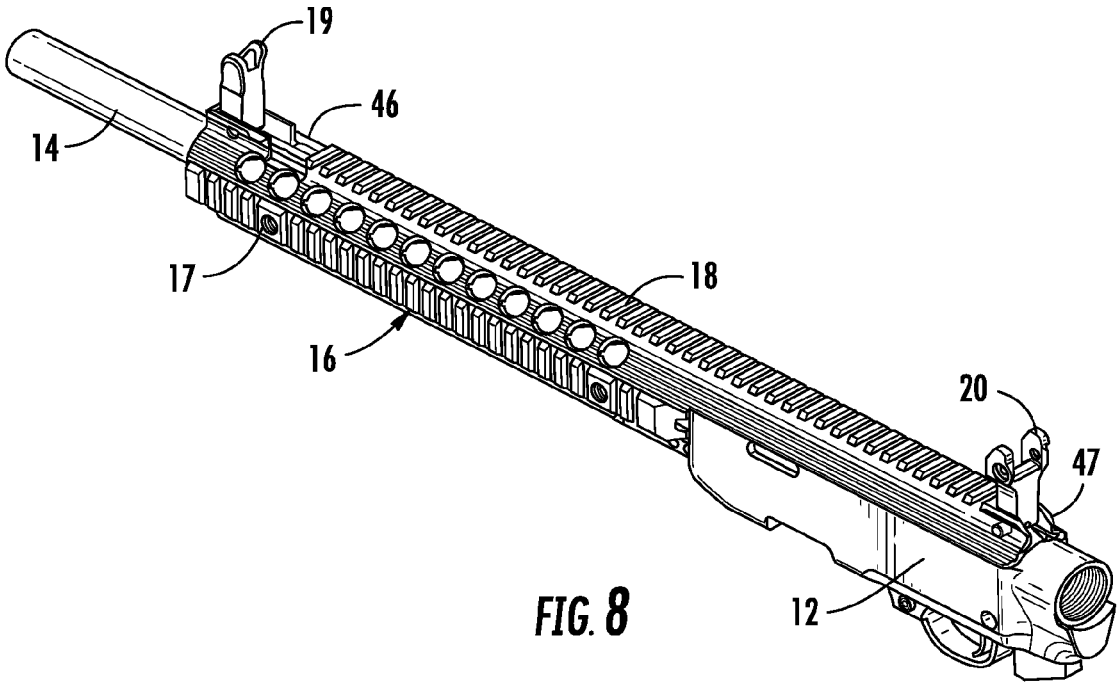
FIG. 8 is a perspective view of the receiver and attached barrel of a conventional firearm, with the chassis and handguard installed.

Turning now to FIGS. 6, 7 and 8, handguard 16 is illustrated. Handguard 16 is preferably of a single piece tubular construction and is positioned over and encircling barrel 14, with a rearward end 43 of handguard portion 17 encircling and engaging barrel support member 32. Rearward end 43 of handguard portion 17 includes a split 44 to facilitate sliding receipt over barrel support member 32. Rearward end 43 with split 44 is movable between a normally expanded configuration (easily received over barrel support member 32) and a contracted configuration securely engaging barrel support member 32. Split 44 is bridged by a clamping member 45 for moving rearward end 43 from the normally expanded configuration to the contracted configuration. Once handguard 16 is properly positioned, split 44 is reduced by tightening clamping member 45, thereby reducing an inner diameter of rearward end 43 of handguard portion 17 to frictionally engage barrel support member 32. In this manner, a free floating handguard can be used with a firearm on which conventional handguards cannot be used.

Figure 9:
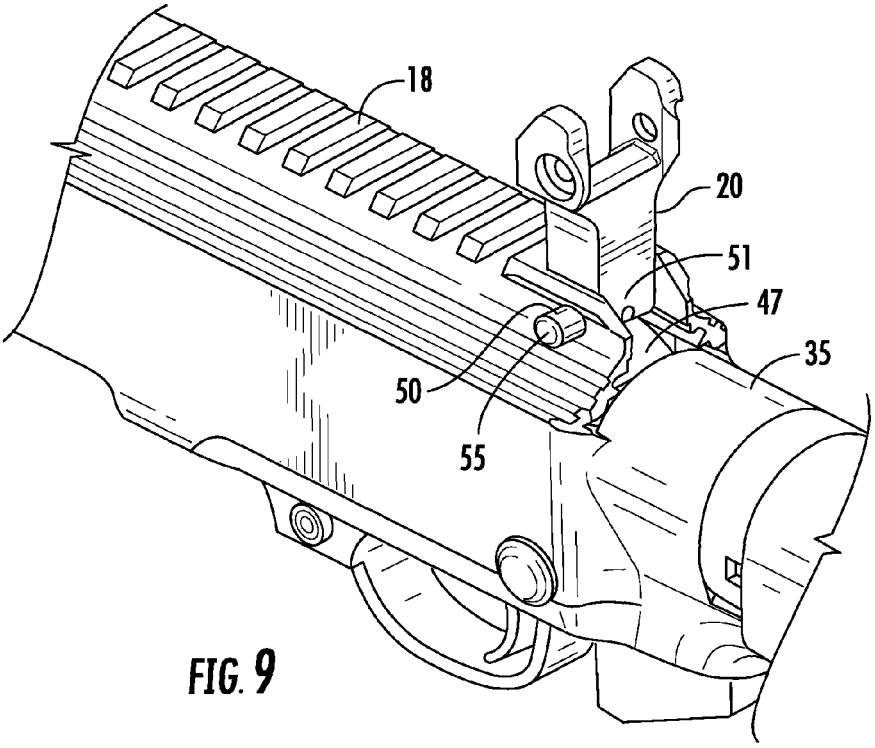
FIG. 9 is an enlarged perspective view of an embedded flip up rear sight of the handguard in the raised position.
Figure 10:
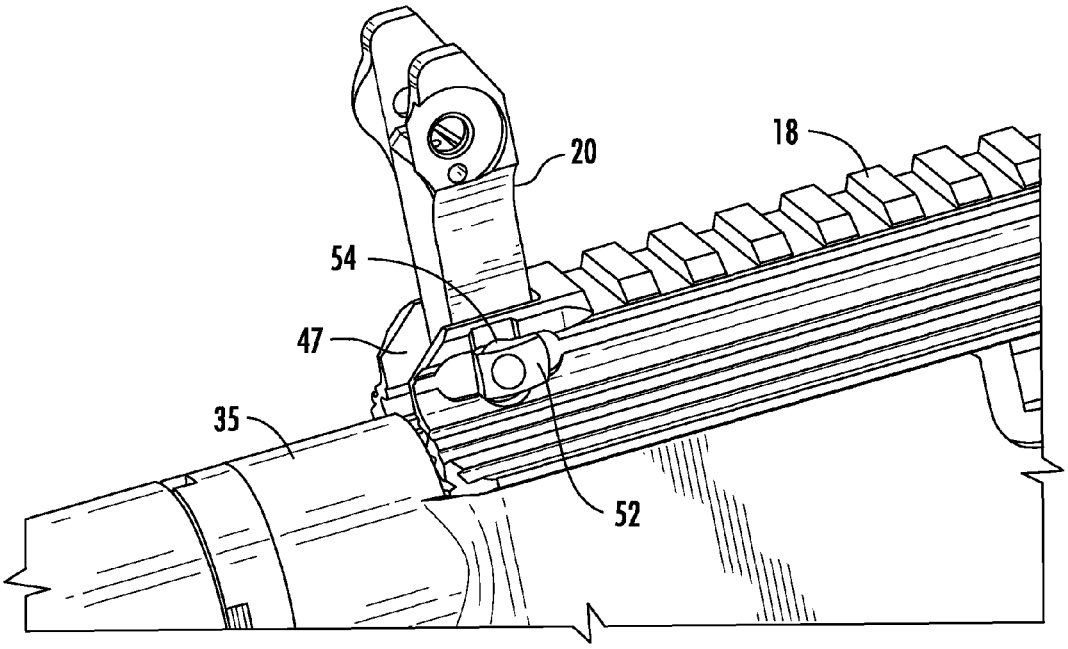
FIG. 10 is an enlarged side perspective view of an embedded flip up rear sight of the handguard in the raised position.
Figure 11:
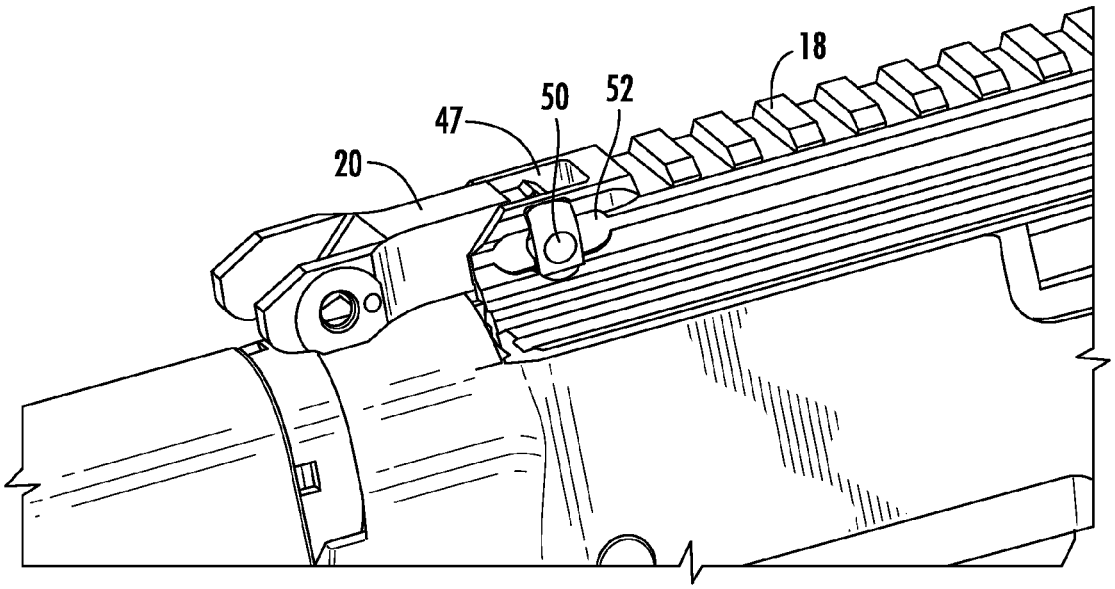
FIG. 11 is an enlarged perspective view of an embedded flip up rear sight of the handguard in the lowered position.

With continued reference to FIGS. 6 and 8, and additional reference to FIGS. 9, 10 and 11, sockets 46 and 47 are provided in rail 18 for receiving embedded front sight 19 and embedded rear sight 20, respectively. Embedded front sight 19 and embedded rear sight 20 are each pivotally movable between raised position and lowered positions. While FIGS. 9, 10, and 11 illustrate rear sight 20, it will be understood that front sight 19 is substantially identical in structure and operation and thus, the mechanism for movement between the raised position and the lowered position will only be described for rear sight 20. A biased pin 50 is journaled through rail 18 at socket 47 and base 51 of rear sight 20. A lock element 52 is carried by one end of pin 50 and is received in indentations 54 formed in the side of rail 18 at socket 47. By pressing opposing end 55 of pin 50 inwardly, locking element 52 is forced out of indentation 54 and sight 20 can be pivoted between the raised and lowered positions. When opposing end 55 is released, a bias, such as by a spring in a well known conventional manner, forces locking element 52 into indentation 54, securing the sight in the position desired. In the lowered position, as can be seen in FIGS. 1 and 11, sights 19 and 20 are flush with or below the level of the surface of rail 18. Thus, in the lowered position, sights 19 and 20 will not interfere with the attachment of components to rail 18 or the use of those components. In the raised position, sights 19 and 20 can be used as conventional sights.

Figure 12:
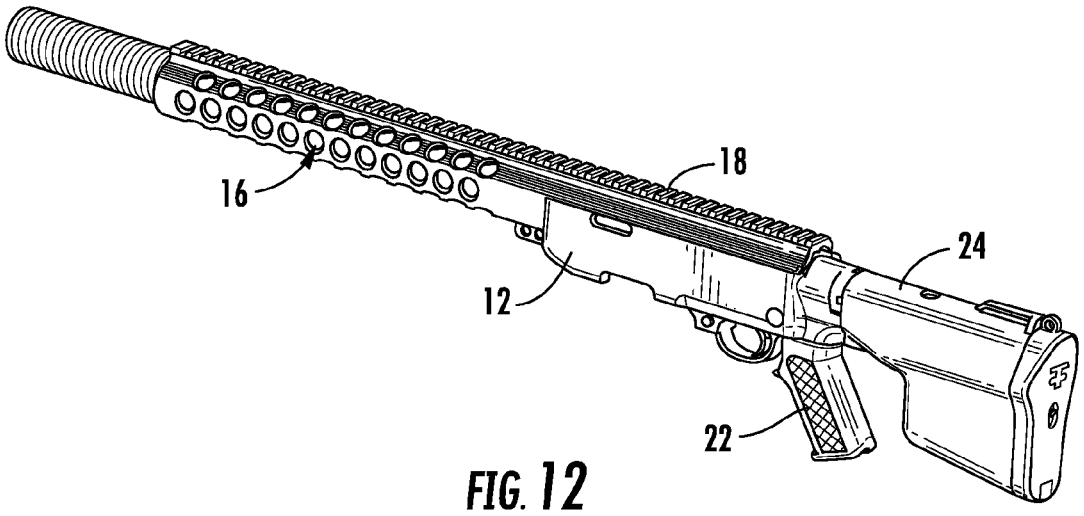
FIG. 12 is a perspective view of the firearm and chassis system including a suppressor.
Figure 13:
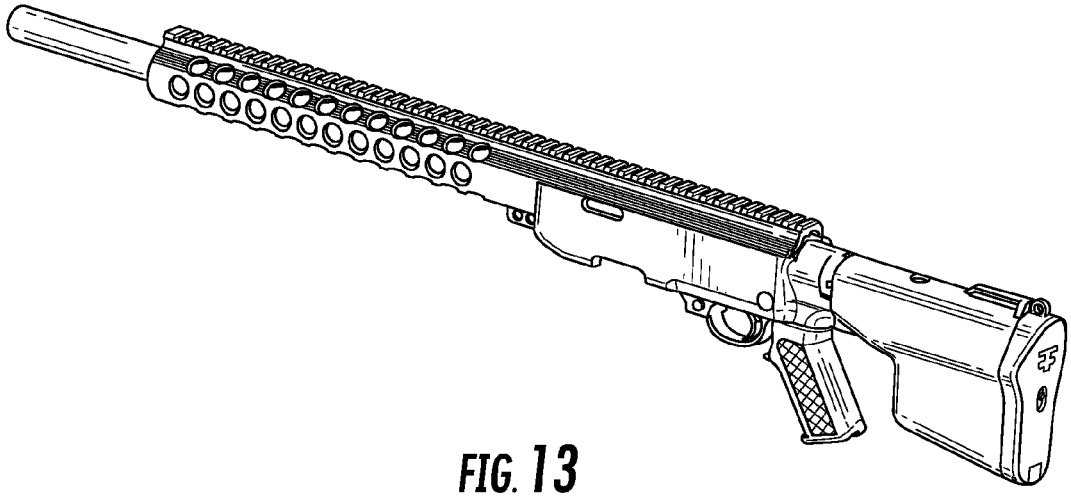
FIG. 13 is a perspective view of the firearm and chassis system including a handguard with no embedded sights.
Figure 14:
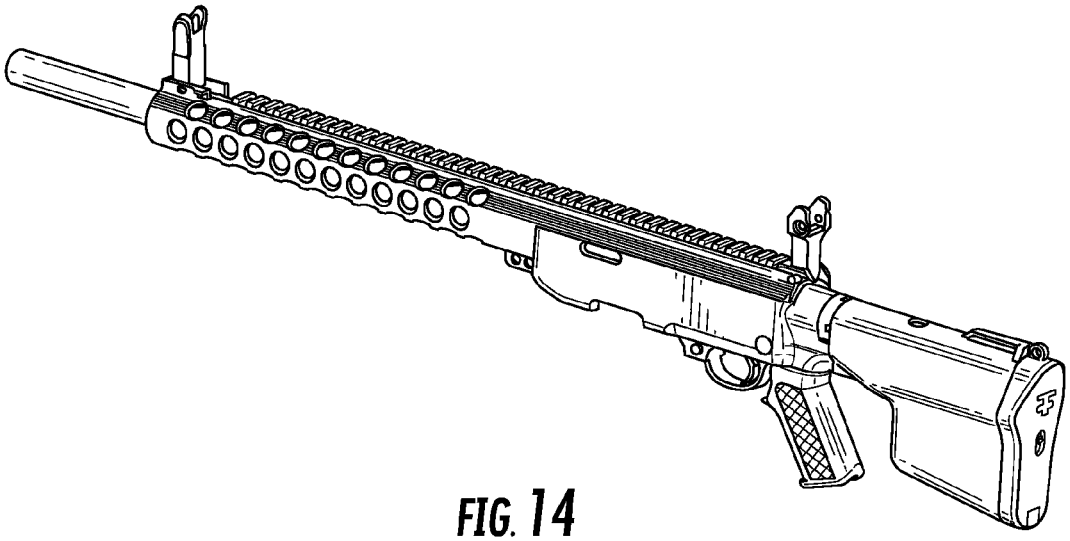
FIG. 14 is a perspective view of the firearm and chassis system including a handguard with embedded sights in the raised position.

Firearm 10 of the present invention can carry various accessories, such as a suppressor as illustrated in FIG. 12. Other embodiments are illustrated in FIGS. 13 and 14, including a handguard without side rails or embedded sights (FIG. 13) or having embedded sights but no side rails (FIG. 14).

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

The invention claimed is:

1. A chassis system for use on a firearm having a barrel extending from a receiver with an attached trigger assembly, the chassis system comprising:

a chassis including a forward end terminating in a barrel support member, a rearward end, and an open top accessing a cavity defined by the chassis intermediate the forward end and the rearward end for receiving a receiver with attached trigger assembly therein, the open top extending to and including the barrel support member, with a portion at a rearward end of a barrel receivable by the barrel support member through the open top at the barrel support member; and a handguard positionable over and completely encircling the barrel without contacting the barrel and in a free floating arrangement, the handguard including a rearward end, the rearward end received over and attached directly to the barrel support member.

2. A chassis system as claimed in claim 1 wherein the chassis further includes a first opening positioned to receive a trigger mechanism of the receiver therethrough, and a second opening provided for access to a magazine well of the receiver.

3. A chassis system as claimed in claim 1 wherein the handguard includes a top rail extending along a length thereof and extending beyond the rearward end thereof for overlying engagement with a receiver.

4. A chassis system as claimed in claim 3 wherein the top rail includes an embedded front sight moveable between a raised position and a lowered position flush with or below a top surface of the top rail.

5. A chassis system as claimed in claim 3 wherein the top rail includes an embedded rear sight moveable between a raised position and a lowered position flush with or below a top surface of the top rail.

6. A chassis system and firearm comprising:

a chassis including a forward end terminating in a barrel support member, a rearward end, and an open top accessing a cavity defined by the chassis intermediate the forward end and the rearward end, the open top extending to and including the barrel support member;

a receiver with a trigger mechanism attached received through the open top and positioned in the cavity;

a barrel coupled to and extending from the receiver, a portion at a rearward end of the barrel received by the barrel support member through the open top at the barrel support member; and a handguard positioned over and completely encircling the barrel without contacting the barrel and in a free floating arrangement, the handguard including a rearward end received over and attached directly to the barrel support member.

7. A chassis system and firearm as claimed in claim 6 wherein the chassis further includes a first opening positioned to receive a trigger mechanism of the receiver therethrough, and a second opening provided for access to a magazine well of the receiver.

8. A chassis system and firearm as claimed in claim 6 wherein the handguard includes a top rail extending along a length thereof and extending beyond the rearward end thereof in overlying engagement with the receiver.

9. A chassis system and firearm as claimed in claim 8 wherein the top rail includes an embedded front sight moveable between a raised position and a lowered position flush with or below a top surface of the top rail.

10. A chassis system and firearm as claimed in claim 8 wherein the top rail includes an embedded rear sight moveable between a raised position and a lowered position flush with or below a top surface of the top rail.

11. A chassis system and firearm comprising:

a chassis including a forward end terminating in a barrel support member, a rearward end terminating in a butt stock receiving member, and an open top accessing a cavity formed in the chassis intermediate the forward end and the rearward end, the open top extending to and including the barrel support member;

a receiver with a trigger mechanism attached received through the open top and positioned in the cavity, the trigger mechanism extending through a bottom opening in the chassis;

a barrel coupled to and extending from the receiver, a portion at a rearward end of the barrel received by the barrel support member through the open top at the barrel support member; and a handguard positioned over and completely encircling the barrel without contacting the barrel and in a free floating arrangement, the handguard including a rearward end, the rearward end received over and attached directly to the barrel support member.

12. A chassis system and firearm as claimed in claim 11 wherein the handguard includes a top rail extending along a length thereof and extending beyond the rearward end thereof in overlying engagement with the receiver.

13. A chassis system and firearm as claimed in claim 12 wherein the top rail includes an embedded front sight moveable between a raised position and a lowered position flush with or below a top surface of the top rail.

14. A chassis system and firearm as claimed in claim 12 wherein the top rail includes an embedded rear sight moveable between a raised position and a lowered position flush with or below a top surface of the top rail.

15. A chassis system and firearm as claimed in claim 11 wherein the chassis further includes a pistol grip receiving member extending from the chassis proximate the rearward end.

16. A chassis system and firearm as claimed in claim 14 further including a socket formed in the top rail, a biased pin journaled through the top rail at the socket and through a base of the rear sight for pivotal movement of the rear sight between a raised position and a lowered position.

17. A chassis system and firearm as claimed in claim 16 further including a lock element carried by an end of the pin, the lock element receivable in selected indentations formed in a side of the top rail at the socket.

* * * * *